US006254047B1

(12) United States Patent
Dedrick

(10) Patent No.: US 6,254,047 B1
(45) Date of Patent: Jul. 3, 2001

(54) EQUIPMENT ROLLER/SLIDE SUPPORT

(75) Inventor: Edward Charles Dedrick, North East, MD (US)

(73) Assignee: The United States of America as represented by the Secretary Department of the Army, Washington, DC (US)

( * ) Notice: Subject to any disclaimer, the term of this patent is extended or adjusted under 35 U.S.C. 154(b) by 0 days.

(21) Appl. No.: 09/321,213

(22) Filed: May 27, 1999

(51) Int. Cl.[7] ..... A47F 5/00; A47B 88/00

(52) U.S. Cl. ..... 248/298.1; 312/330.1; 384/18; 384/45

(58) Field of Search ..... 248/298.1, 675, 248/424, 429, 659; 211/94, 94.5; 312/330.1; 384/18, 45

(56) References Cited

U.S. PATENT DOCUMENTS 4,040,679 * 8/1977 Teramachi ..... 384/45
4,253,709 * 3/1981 Teramachi ..... 384/45
4,608,621 * 8/1986 Porter ..... 361/827
4,621,876 * 11/1986 Reimer ..... 312/330.1
4,968,155 * 11/1990 Bode ..... 384/45
5,419,639 * 5/1995 Hobbs et al. ..... 384/18

* cited by examiner

*Primary Examiner*—Anita M. King
(74) *Attorney, Agent, or Firm*—William Randolph; William Medsger; Edward Stolarun

(57) ABSTRACT

A roller slide apparatus for mounting heavy equipment on support structures and which allows safe repositioning of the equipment for servicing and repair includes a lower plate assembly connected to a support structure, an upper mounting plate connected to the equipment, and a bearing assembly connected to both the lower mounting plate assembly and the upper mounting plate for facilitating movement of the upper mounting plate from a first operative position where the upper mounting plate is substantially superimposed over the lower mounting plate assembly to a second operative position where the upper mounting plate is moved away from the lower mounting plate assembly. Locking devices for maintaining the upper mounting plate in either the first or second operative positions, includes flanges formed on the mounting plates and extensions that slide into holes formed in flange or plate elements.

11 Claims, 5 Drawing Sheets

EQUIPMENT ROLLER/SLIDE SUPPORT

BACKGROUND OF THE INVENTION

This invention generally relates to equipment supports, and more particularly, to supports for equipment which allows the equipment to be safely withdrawn from a substructure for servicing and maintenance.

Refrigerated containers are utilized by the military to transport and store a variety of items, such as food and medical supplies. Designed for a variety of use conditions, they are often transported to remote locations with harsh environments. In such instances, electrical power for the containers is provided by electrical generators which are attached to the containers. The size of a refrigeration container used by the military may be on the order of about 8-foot wide, by 8-foot high, by 20-foot long. A refrigeration container of this size would have an interior refrigeration volume of about 7-foot, by 7-foot, by 16-foot long. The internal temperature of the container is controlled by an environmental control unit, which is designed to maintain the contents at stable temperatures between 0 and 40 degrees under varying conditions. For refrigeration containers of this size, power for the environmental control unit may be on the order of a 10 kilowatt generator.

To prevent damage to the generators and other equipment during shipping and use, it is necessary to ensure that the equipment is securely mounted to the containers. It is also necessary to periodically service and repair the generators and other equipment to check coolant levels, hoses, fan belts, filter elements, oil levels, and electrical connections. Depending on the particular configuration of the container and the manner in which the generator and other equipment such as compressors and pumps are mounted on the container, complete access to the generator and other equipment may be restricted. This becomes particularly important when the generator and other equipment must be serviced and repaired, often during severe use conditions.

To access a generator or other equipment for maintenance or servicing, the the equipment may be either removed from the container or mounted on moveable platforms in such manner that the equipment can be repositioned on the container for better access to the equipment. Generators and other equipment for containers must be mounted so that structural specifications, transport requirements, and safety guidelines are satisfied. Tests to certify that the various requirements have been met may include drop tests, vibration tests, road shock tests, and fatigue tests. In addition, for moveable platforms, the platform must meet safety standards for the various positions of use.

SUMMARY OF THE INVENTION

The present invention is directed to an apparatus for mounting equipment on a structure so that the equipment can be moved or repositioned relative to the structure for maintenance and repair. Consistent with the present invention is a mounting apparatus that is durable enough to survive harsh use requirements and which provides a safe environment for maintenance and repair work. The apparatus includes a lower mounting plate assembly connected to the structure, an upper mounting plate connected to the equipment, and a bearing assembly connected to both the lower mounting plate assembly and the upper mounting plate for facilitating the movement of the upper mounting plate from a first operative position where the upper mounting plate is substantially superimposed over the lower mounting plate assembly to a second operative position where the upper mounting plate is moved away from the lower mounting plate assembly.

During normal use conditions, locking devices are connected to the lower mounting plate assembly and the upper mounting plate for maintaining the upper mounting plate and the lower mounting plate assembly in the first operative position. The locking devices include flanges formed on both the upper and lower mounting plates that become disposed in an abutting, adjacent relationship when the apparatus is in the first operative position. The flanges can be locked together. The locking devices also include an extension on the bearing assembly that engages into a hole formed in a flange on the lower mounting plate assembly when the apparatus is in the first operative position.

For servicing, safety devices are utilized to limit or stop the movements of the upper mounting plate relative to the lower mounting plate assembly. To limit the extent of the outward movement of the upper mounting plate, flanges are secured to the mounting plates. Safety stops are used for holding the mounting plates in position during the process of unlocking the flanges and for holding the mounting plates in the second or withdrawn position.

Accordingly, one object of the present invention is to provide a compact assembly of self-contained, efficient design for the support and servicing of equipment.

Another object of the present invention is to provide an equipment mounting assembly that is safe and simple to use.

These, together with still other objects of the invention, along with the various features that characterize the invention, are pointed out with particularity in the appended claims.

BRIEF DESCRIPTION OF THE INVENTION

Other objects and advantages of the invention will become apparent upon reading the following detailed description with reference to the attached drawings, wherein.

DETAILED DESCRIPTION OF THE PREFERRED EMBODIMENT

Figure 1:
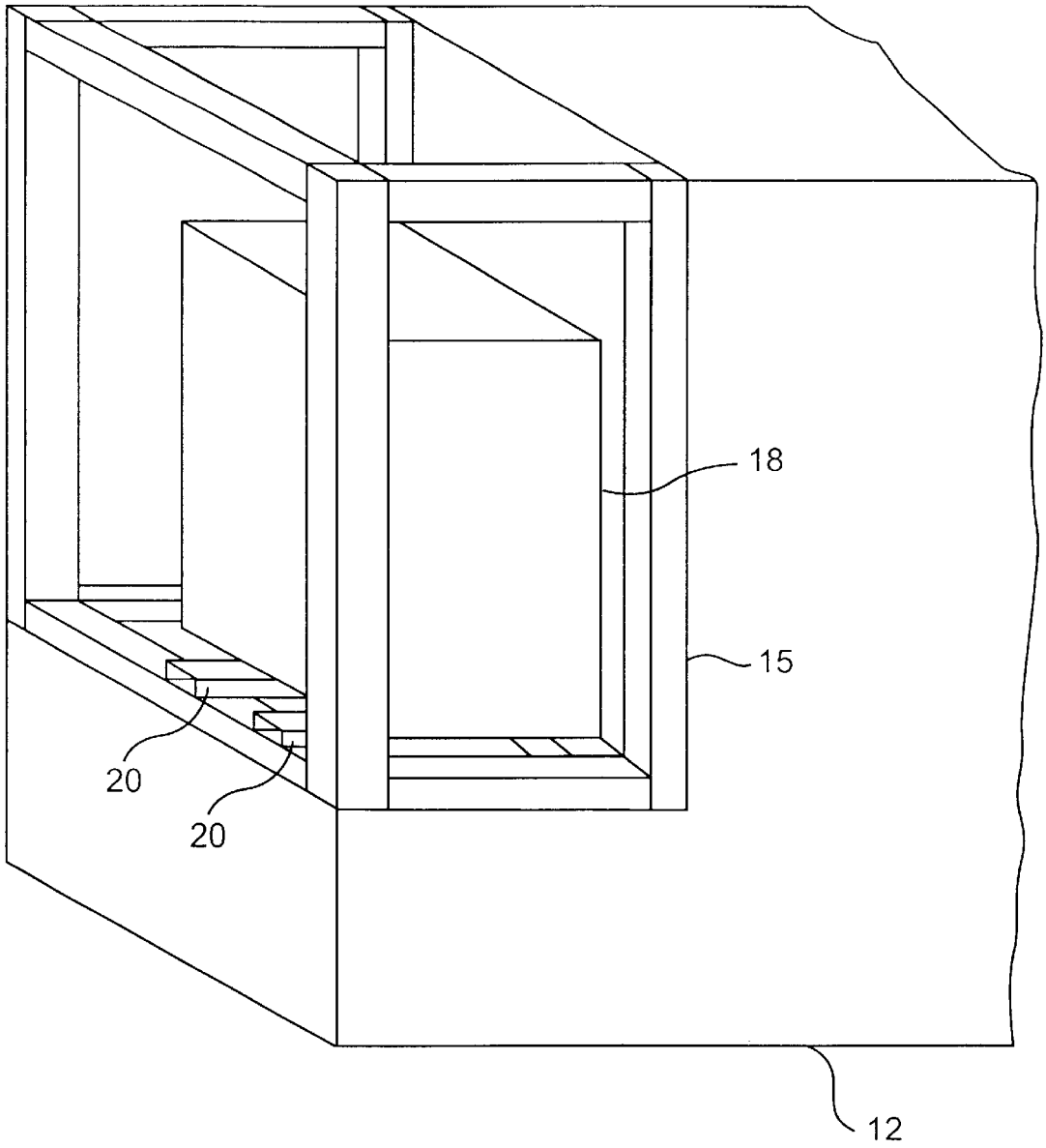
FIG. 1 is a view of a generator mounted onto a container structure.
Figure 2:
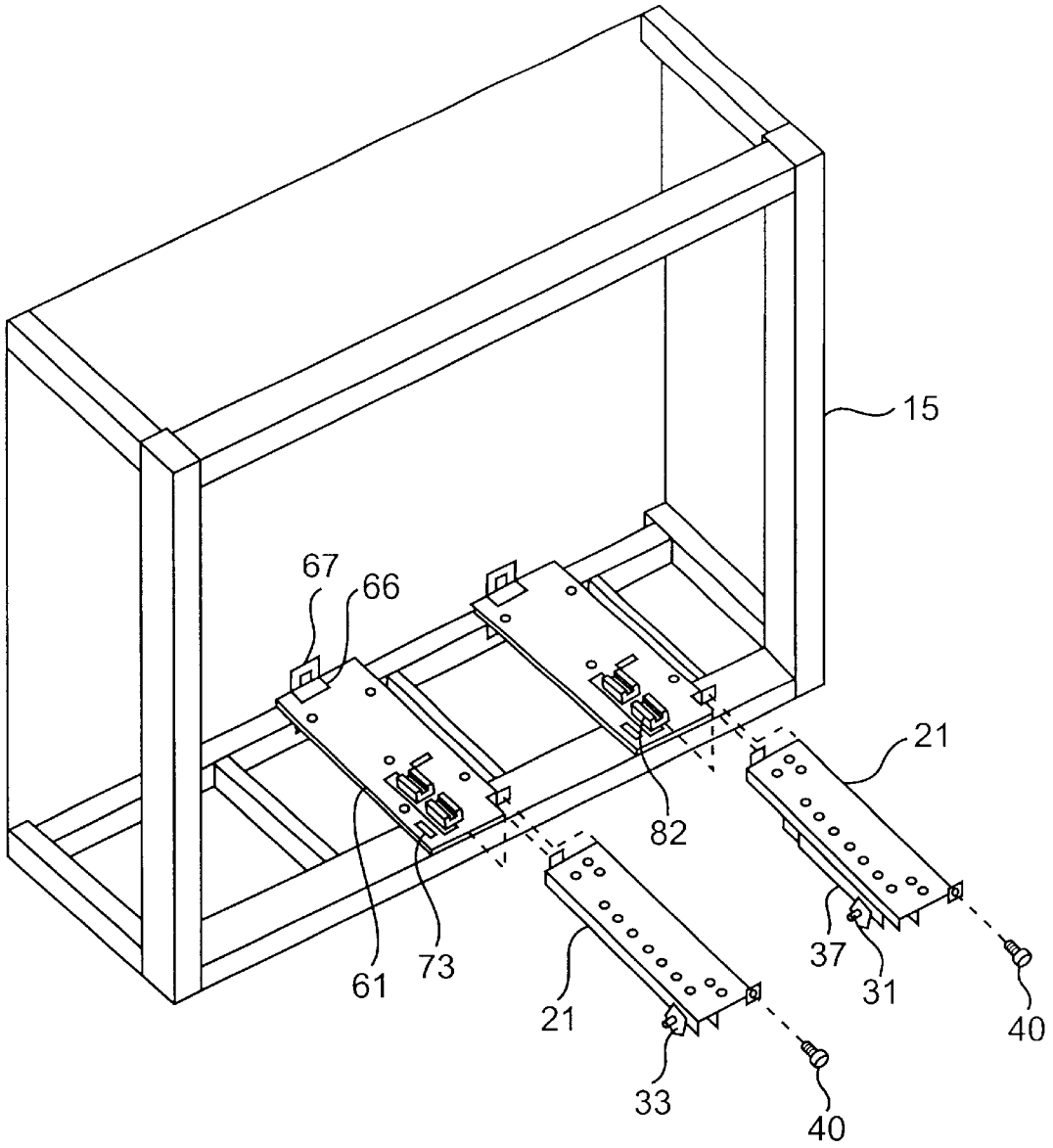
FIG. 2 is a general exploded view of a mounting assembly.

Referring now to FIG. 1, there is generally shown a generator 18 attached to two spaced apart mounting assemblies 20, which are only partially shown. The mounting assemblies 20 are connected to a frame or substructure 15 of the container 12. In addition to the generator 18, other equipment may also be mounted onto the substructure 15. FIG. 2 shows a general exploded view of the mounting assemblies 20 including an upper mounting plate 21 and a lower mounting plate 61 that is secured to the substructure 15.

Figure 3:
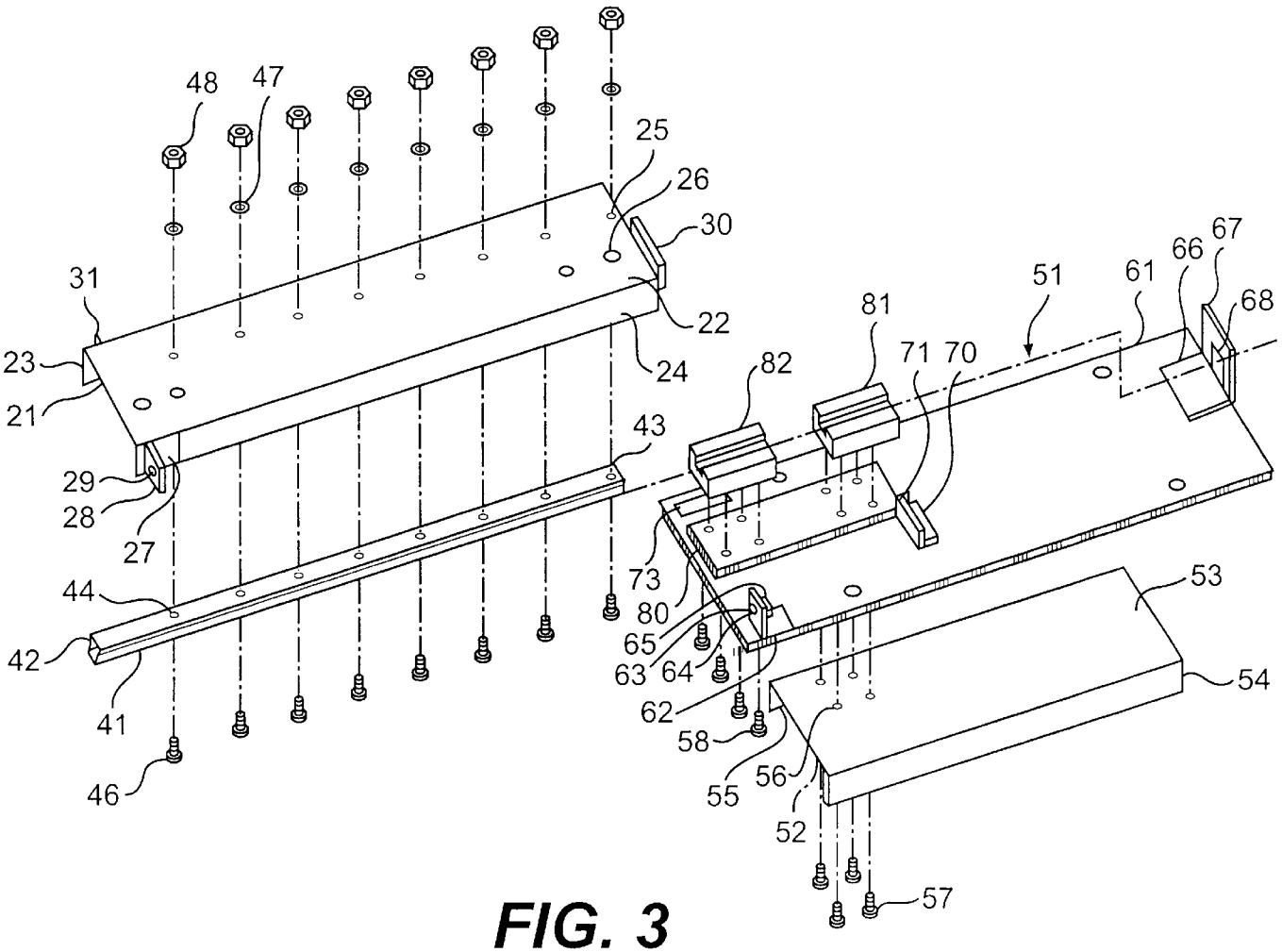
FIG. 3 is an expanded exploded view of a mounting assembly.

FIG. 3 is an expanded, exploded view of a mounting assembly 20, including an upper mounting plate 21, a lower mounting plate 61, an elongated rail 41, and a support plate 52 for stiffening the lower mounting plate 61. The moveable parts of the mounting assembly 20 that are directly connected to a generator or other equipment include upper mounting plate 21 and an elongated rail 41. Upper mounting plate 21 includes an elongated planar section 22 and depending sidewalls 23 and 24. Mounting holes 26 are provided in the surface 22 for mounting generators or other equipment to the mounting plate 21. An L-shaped member 27 having a flange portion 28 with a hole 29 formed therein is secured to the sidewall 24 at the first or front end of the upper mounting plate 21. The front end of the mounting plate 61 also has an L-shaped bracket 62 having a flange portion 63 with a hole 64 and a nut 65 which is welded to the flange 63. The flanges 28 and 63 form a first locking means for locking the mounting plates 21 and 61 together. In locking the mounting plates 21 and 61 together, a threaded fastener 40 is inserted through holes 29 and 64 and is then threaded into nut 65.

In FIG. 3, the elongated rail 41 is connected to the upper mounting plate 21 with a plurality of threaded fasteners 46 that pass through holes 44 in the rail 41, holes 25 in mounting plate 21, lock washers 47 and engage nuts 48. The rail 41 has a first end portion 42 and a second end portion 43 that projects slightly beyond the rear of the upper mounting plate 21 when the rail is connected thereto. The rail 41 and bearings 81 and 82 form a slide bearing in which the rail 41 slides through the relatively fixed bearings 81 and 82. This type of bearing is exemplified for example in U.S. Pat. Nos. 4,040,649 and 4,296,974, the teachings of which are incorporated by reference.

The lower mounting assembly 51 includes a support plate 52 and a lower mounting plate 61. The support plate 52 reinforces the lower mounting plate 61 and functions as a means for bolting, clamping, welding or otherwise connecting the lower mounting plate 61 to the substructure 15. As shown in FIG. 3, the support plate 52 is elongated and provided with a channel-shaped cross-section, with a top planar section 53 and depending sidewalls 54 and 55. The lower mounting plate 61 is secured to the support plate 52 with threaded fasteners 57 which pass through holes 56 in the top surface 53 of the support plate 52, the reinforcing plate 80, and are connected to the first bearing element 81. While threaded means are shown for connecting one or more parts of the lower mounting assembly 51, other connecting means such as welding may be used. The first and second bearing assemblies 81 and 82 are attached to a first or front end of the mounting plate 61. The second bearing 82 is secured to the reinforcing plate 80 and mounting plate 61 with threaded fasteners 58.

In FIG. 3, affixed to the surface of the lower mounting plate 61 generally adjacent to the reinforcing plate 80 is an L-shaped member or angle 70 with a vertical flange portion 71. Another flange 30 is secured to the rear or second end of the upper mounting plate 21. The flanges 30 and 71 cooperatively engage one another to form a stop means for limiting the outward movement of the upper mounting plate 21 relative to the fixed lower mounting plate 61.

Figure 4:
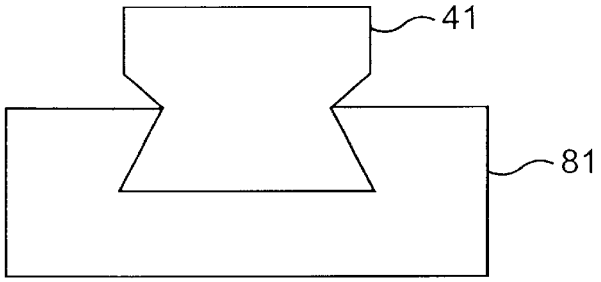
FIG. 4 is an end view of the slide bearing elements.

When the mounting assembly is in operative position, the elongated bearing rail 41 is inserted into the bearings 81 and 82 as depicted in the end view shown in FIG. 4. With the bearings 81 and 82 being fixed to the lower mounting plate 61, the rail 41 and upper mounting plate 21 are designed to slide through the bearings as generally indicated by the horizontal broken lines of FIG. 3. In the first or closed operative position the rear or second end portion 43 of the rail 41 is designed to slide into an opening 68 formed in a vertical flange portion 67 of an angle or bracket 66. The engagement of the end portion 43 of elongated rail 41 with the flange 67 forms an additional locking means for preventing lateral and vertical displacements of the upper mounting plate 21 and provides a means for absorbing and dissipating shocks and vibrations that normally occur during transport and use.

Figure 6:
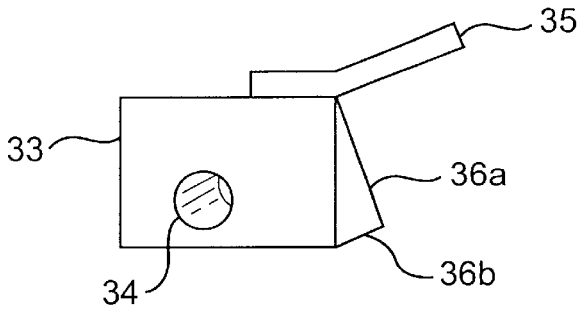
FIG. 6 is a plan view of the first stop member.
Figure 8:
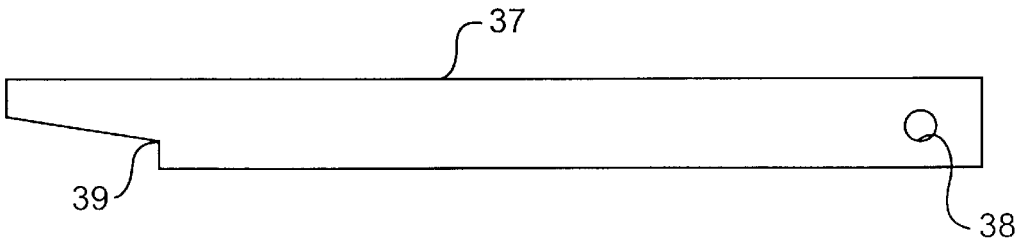
FIG. 8 is a plan view of the second stop member.
Figure 5:
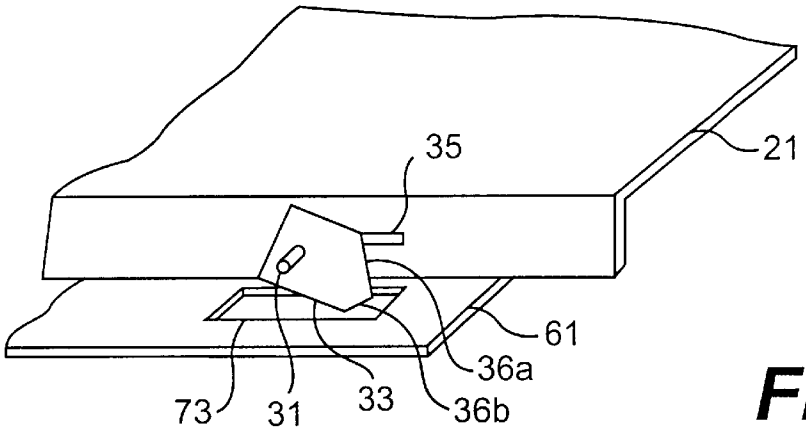
FIG. 5 is a partial view depicting a first stop member.
Figure 7:
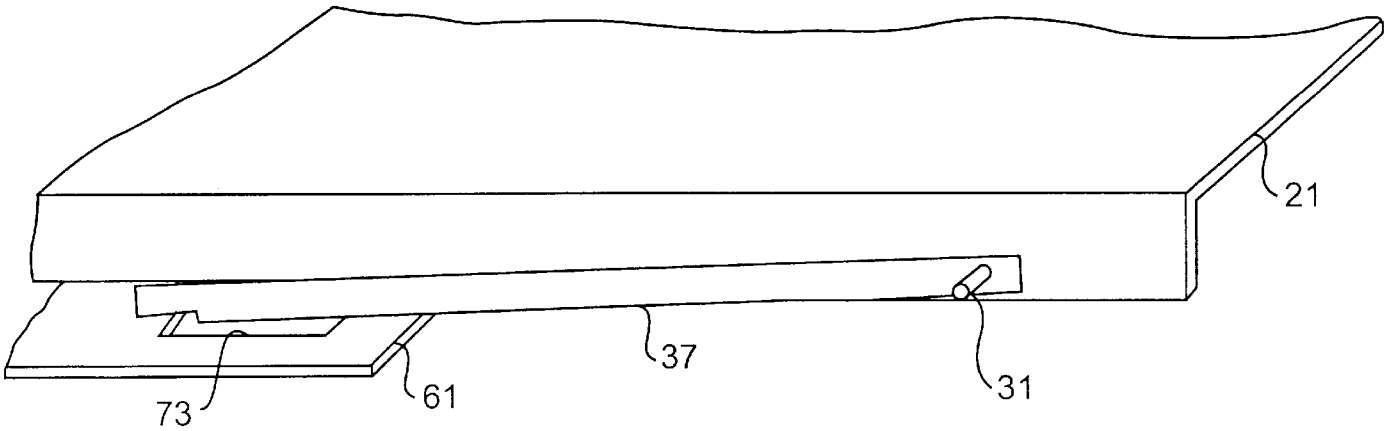
FIG. 7 is a partial view depicting a second stop member.

When the mounting assembly 20 is in the locked or first use position, the upper mounting plate 21 generally overlies lower mounting plate 61 with the end portion 43 of rail 41 inserted through opening 68, and the flanges 28 and 63 are disposed together. Upon removal of the threaded fastener or bolt from the flanges 28 and 63, the upper mounting plate 21 and the lower mounting plate 61 become unlocked from each other. To prevent sudden unprepared movements of the upper mounting plate 21, such as may occur if the container was parked on a slope, a first safety stop is provided in the form of member 33 as shown in FIGS. 5 and 6. The first stop means in the form of member 33 has a mounting hole 34 for mounting member 33 on a stud 31 projecting from the front end portion of the upper mounting plate 21. A lift tab 35 is used for pivoting stop member 33 from a first position where surface portions **36*a* and 36*b* rests in slot 73 to a second position where surface portions are lifted out of the slot 73. In the first operative position, surface 36*a* is intended to contact the walls of upper mounting plate 21 that define slot 73 and surface 36*b* is intended to rest on the substructure 15. This allows the safe unlocking of the flanges 28 and 63. A second stop means in the form of member 37 is used for preventing the closing or inward movement of the upper mounting plate 21 after it has been moved away from the lower mounting plate 61. As shown in FIGS. 7 and 8, the second stop member 37 has a mounting hole 38 for mounting the stop member onto a stud 31 in such a manner that the surface 39 is able to slip into slot 73 and prevent the upper mounting plate 21 from moving back toward the closed or first position while the generators and other equipment are being serviced. While the stop members of FIG. 2 are shown as being connected to different upper mounting plates 61, they could also be connected to the stud 31** of the same mounting plate.

It should be understood that the foregoing description is only illustrative of the invention and that various alterations and modifications can be made by those skilled in the art without departing from the principles and concepts of the invention. Accordingly, the present invention is intended to encompass all such alternatives, modifications, and variations which fall within the scope of the appended claims.

What is claimed is:

1. A equipment support apparatus for mounting equipment on a support structure and for allowing movement of equipment for maintenance and repair, comprising:

a lower mounting plate assembly for being mounted on a support structure;

an upper mounting plate for supporting equipment;

bearing means connected to the lower mounting plate assembly and the upper mounting plate for facilitating movement of the upper mounting plate relative to the lower mounting plate assembly from a first operative position where the upper mounting plate is substantially superimposed over the lower mounting plate assembly to a second operative position where the upper mounting plate is moved away from the lower mounting plate assembly;

locking means connected to the lower mounting plate assembly and the upper mounting plate for maintaining the upper mounting plate and the lower mounting plate assembly in the first operative position; and stop means connected to the lower mounting plate assembly and the upper mounting plate for controlling the relative movement of the upper mounting plate from the lower mounting plate assembly when the lower mounting plate assembly and the upper mounting plate are in the first and second operative positions, wherein the lower mounting plate assembly includes an elongated lower mounting plate having first and second end portions, wherein the upper mounting plate is elongated and has first and second end portions, and wherein the locking means includes a first flange with a hole formed therein connected to the first end portion of the lower mounting plate, a second flange with a hole formed therein connected to the first end portion of the upper mounting plate and a locking device for passing through the holes in the first and second flanges and for locking the upper mounting plate and the lower mounting plate assembly in the first operative position.

2. The apparatus according to claim 1, wherein the bearing means comprises an elongated rail member having a first and second end portions, wherein the first end portion of the rail member is connected to the first end portion of the upper mounting plate and the second end portion of the rail member is connected to the second end portion of the upper mounting plate, and a generally channel-shaped bearing member secured to the first end portion of the lower mounting plate for receiving the rail member.

3. The apparatus according to claim 2, wherein the locking means further comprises a plate member secured to the second end portion of the lower mounting plate and having an aperture formed therein so that when the upper mounting plate and the lower mounting plate are disposed in the first operative position, the second end portion of the rail member passes through the aperture in the plate member for preventing lateral and vertical displacements of the upper mounting plate relative to the lower mounting plate.

4. The apparatus according to claim 3, wherein a slot is formed in the first end portion of the lower mounting plate and wherein the stop means includes a first stop member pivotally connected to the upper mounting plate and moveable from a first position where the first stop member is disposed in the slot to a second position where the first stop member is lifted out of the slot to permit movement of the upper and lower mounting plates from their first operative position.

5. The apparatus according to claim 4, wherein the stop means further includes an elongated second stop member pivotally connected to the upper mounting plate and moveable from a first position where the second stop member is positioned out of the slot to a second position is disposed in the slot to prevent movement of the upper and lower mounting plates from their second operative position.

6. A equipment support apparatus for mounting equipment on a support structure and for allowing movement of equipment for maintenance and repair, comprising:

a lower mounting plate assembly for being mounted on a support structure;

an upper mounting plate for supporting equipment;

bearing means connected to the lower mounting plate assembly and the upper mounting plate for facilitating movement of the upper mounting plate relative to the lower mounting plate assembly from a first operative position where the upper mounting plate is substantially superimposed over the lower mounting plate assembly to a second operative position where the upper mounting plate is moved away from the lower mounting plate assembly;

locking means connected to the lower mounting plate assembly and the upper mounting plate for maintaining the upper mounting plate and the lower mounting plate assembly in the first operative position; and stop means connected to the lower mounting plate assembly and the upper mounting plate for controlling the relative movement of the upper mounting plate from the lower mounting plate assembly when the lower mounting plate assembly and the upper mounting plate are in the first and second operative positions, wherein a slot is formed in the end portion of the lower mounting plate assembly and wherein the stop means includes a first stop member pivotally connected to the upper mounting plate and moveable from a first position where the first stop member is disposed in the slot to a second position where the first stop member is lifted out of the slot to permit movement of the upper mounting plate relative to the lower mounting plate assembly from the first operative position.

7. The apparatus according to claim 6, wherein the stop means further includes an elongated second stop member pivotally connected to the upper mounting plate and moveable from a first position where the elongated second stop member is positioned out of the slot to a second position where the elongated second stop member is disposed in the slot to prevent movement of the upper mounting plate relative to the lower mounting plate assembly from the second operative position.

8. An equipment support apparatus for mounting equipment on a support structure and for allowing movement of equipment for maintenance and repair, comprising:

an elongated lower mounting plate assembly for being mounted on a support structure;

an elongated upper mounting plate supporting equipment;

bearing means connected to the lower mounting plate assembly and the upper mounting plate for facilitating movement of the upper mounting plate relative to the lower mounting plate assembly from a first operative position where the upper mounting plate is substantially superimposed over the lower mounting plate assembly to a second operative position where the upper mounting plate is moved away from the lower mounting plate assembly;

locking means connected to the lower mounting plate assembly and the upper mounting plate for maintaining the upper mounting plate and the lower mounting plate assembly in the first operative position, wherein the locking means comprises a first lock means including a first flange connected to a first end portion of the lower mounting plate assembly, a second flange connected to a first end portion of the upper mounting plate and a locking device for securing the first and second flanges together, and a second lock means including a plate member secured to a second end portion of the lower mounting plate assembly and having an aperture formed therein so that when the upper mounting plate and the lower mounting plate assembly are disposed in the first operative position, the bearing means engages the aperture in the plate member for preventing lateral and vertical displacements of the upper mounting plate relative to the lower mounting plate assembly; and stop means connected to the lower mounting plate assembly and the upper mounting plate for controlling the relative movement of the upper mounting plate away from the lower mounting plate assembly when the lower mounting plate assembly and the upper mounting plate are disposed in the first and second operative positions.

9. The apparatus according to claim 8, wherein the bearing means comprises an elongated rail member having first and second end portions, wherein the first end portion of the rail member is connected to the first end portion of the upper mounting plate and the second end portion of the rail member is connected to the second end portion of the upper mounting plate, and a generally channel-shaped bearing member secured to the first end portion of the lower mounting plate assembly for receiving the rail member.

10. The apparatus according to claim 8, wherein a slot is formed in the first end portion of the lower mounting plate and wherein the stop means includes a first stop member pivotally connected to the upper mounting plate and moveable from a first position where the first stop member is disposed in the slot to a second position where the first stop member is lifted out of the slot to permit movement of the upper mounting plate from the first operative position.

11. The apparatus according to claim 8, wherein the stop means further includes an elongated second stop member pivotally connected to the upper mounting plate and moveable from a first position where the second stop member is positioned out of the slot to a second position where the second stop member is disposed in the slot to prevent movement of the upper mounting plate from the second operative position.

* * * * *